US005989793A

United States Patent [19]

Sowinski et al.

[11] Patent Number: 5,989,793

[45] Date of Patent: Nov. 23, 1999

[54] COLOR NEGATIVE PHOTOGRAPHIC ELEMENTS WITH MODIFIED SCAVENGING COMPOUND DISTRIBUTIONS

[75] Inventors: Allan F. Sowinski, Rochester; William J. Begley, Webster; Stephen P. Singer, Spencerport, all of N.Y.

[73] Assignee: Eastman Kodak Company, Rochester, N.Y.

[21] Appl. No.: 09/104,569

[22] Filed: Jun. 25, 1998

[51] Int. Cl.[6] ..... G03C 1/46

[52] U.S. Cl. ..... 430/505; 430/506

[58] Field of Search ..... 430/505, 506

[56] References Cited

U.S. PATENT DOCUMENTS

| | | |
|---|---|---|
| 3,843,369 | 10/1974 | Kumai et al. . |
| 5,314,793 | 5/1994 | Chang et al. . |
| 5,360,703 | 11/1994 | Chang . |
| 5,389,506 | 2/1995 | Sutton . |
| 5,585,230 | 12/1996 | Zengerle et al. . |
| 5,629,140 | 5/1997 | Harder et al. . |

FOREIGN PATENT DOCUMENTS

| | | |
|---|---|---|
| 0 556 700 A1 | 8/1993 | European Pat. Off. . |
| 2 302 411 | 1/1997 | United Kingdom . |

OTHER PUBLICATIONS

Reserach Disclosure, Item 38957, vol. 389, Sep. 1996, X.C.
Research Disclosure, Item 38957, vol. 389, Sep. 1996, X.D.
Research Disclosure, Item 38957, vol. 389, Sep. 1996. XII.

*Primary Examiner*—Richard L. Schilling
*Assistant Examiner*—Amanda C. Walker
*Attorney, Agent, or Firm*—Sarah Meeks Roberts

[57] ABSTRACT

A color negative photographic element is disclosed containing higher levels of oxidized developer agent scavenging compound in the lowest and intermediate sensitivity layers of a triple-coated image recording unit than in the fast layer. Reduced fog and granularity are obtained, and increased speed and latitude are obtained.

8 Claims, No Drawings

COLOR NEGATIVE PHOTOGRAPHIC ELEMENTS WITH MODIFIED SCAVENGING COMPOUND DISTRIBUTIONS

FIELD OF THE INVENTION

The invention relates to color photography. More specifically, the invention relates to silver halide color negative photographic elements containing dye image-forming couplers and oxidized developing agent scavenger compound.

DEFINITION OF TERMS

In referring to grains and emulsions containing two or more halides, the halides are named in order of ascending concentrations.

The terms "high chloride" and "high bromide" in referring to grain and emulsion halide compositions indicates chloride or bromide concentration of greater than 50 mole percent, based on silver.

In referring to grains, "ECD" indicates mean equivalent circular diameter and, in describing tabular grains, "t" indicates mean tabular grain thickness.

References to blue, green and/or red spectral sensitizing dyes indicate dyes that absorb blue, green or red light and transfer absorbed photon energy to silver halide grains when adsorbed to their surfaces.

In referring to blue, green and red recording dye image-forming layer units, the term "layer unit" indicates the hydrophilic colloid layer or layers that contain radiation-sensitive silver halide grains to capture exposing radiation and couplers that react upon development of the grains. The grains and couplers are usually in the same layer, but can be in adjacent layers.

The term "coupler" indicates a compound that reacts with oxidized color developing agent to create or modify the hue of a dye chromophore.

The term "dye image-forming coupler" indicates a coupler that reacts with oxidized color developing agent to produce an image dye.

The term "colored masking coupler" indicates a coupler that is initially colored and that loses its initial color during development upon reaction with oxidized color developing agent.

The term "substantially free of colored masking coupler" indicates a total coating coverage of less than 0.09 millimole/$m^2$ of colored masking coupler in a color negative element.

The terms "oxidized developing agent scavenging compound" and "oxidized developing agent scavenger" indicate a compound that reacts with oxidized color developing agent to produce a substantially colorless compound.

The term "substantially free of oxidized developing agent scavenging compound" indicates a coating coverage of less than 0.03 millimole/$m^2$ of oxidized developer agent scavenging compound in a dye image-forming layer.

The term "development inhibitor releasing compound" or "DIR" indicates a compound that cleaves to release a development inhibitor during color development. As defined DIR's include couplers and other compounds that utilize anchimeric and timed releasing mechanisms.

The term "color negative" refers to a photographic element that contains a negative-working silver halide emulsion and undergoes a single development step to produce a dye image.

The term "E" is used to indicate exposure in lux-seconds.

Widely used color negative processing is the Kodak Flexicolor™ color negative process. Since minor adjustments of the C-41 process are undertaken from time to time, the following detailed description is provided:

| | | | |
|---|---|---|---|
| Develop | 3'15" | Developer | 37.8° C. |
| Bleach | 4' | Bleach | 37.8° C. |
| Wash | 3' | | 35.5° C. |
| Fix | 4' | Fixer | 37.8° C. |
| Wash | 3' | | 35.5° C. |
| Rinse | 1' | Rinse | 37.8° C. |

Developer

| | |
|---|---|
| Water | 800.0 mL |
| Potassium Carbonate, anhydrous | 34.30 g |
| Potassium bicarbonate | 2.32 g |
| Sodium sulfite, anhydrous | 0.38 g |
| Sodium metabisulfite | 2.96 g |
| Potassium Iodide | 1.20 mg |
| Sodium Bromide | 1.31 g |
| Diethylenetriaminepentaacetic acid pentasodium salt (40% soln) | 8.43 g |
| Hydroxylamine sulfate | 2.41 g |
| N-(4-amino-3-methylphenyl)-N-ethyl-2-aminoethanol | 4.52 g |
| Water to make | 1.0 L |
| pH @ 26.7° C. 10.00 +/− 0.05 | |

Bleach

| | |
|---|---|
| Water | 500.0 mL |
| 1,3-Propylenediamine tetra-acetic acid | 37.4 g |
| 57% Ammonium hydroxide | 70.0 mL |
| Acetic acid | 80.0 mL |
| 2-Hydroxy-1,3-propylenediamine tetraacetic acid | 0.8 g |
| Ammonium Bromide | 25.0 g |
| Ferric nitrate nonahydrate | 44.85 g |
| Water to make | 1.0 L |
| pH 4.75 | |

Fix

| | |
|---|---|
| Water | 500.0 mL |
| Ammonium Thiosulfate (58% solution) | 214.0 g |
| (Ethylenedinitrilo)tetraacetic acid disodium salt, dihydrate | 1.29 g |
| Sodium metabisulfite | 11.0 g |
| Sodium Hydroxide (50% solution) | 4.70 g |
| Water to make | 1.0 L |
| pH at 26.7° C. 6.5 +/− 0.15 | |

Rinse

| | |
|---|---|
| Water | 900.0 mL |
| 0.5% Aqueous p-tertiary-octyl-(α-phenoxypolyethyl)alcohol | 3.0 mL |
| Water to make | 1.0 L |

The term "gamma" is employed to indicate the incremental increase in image density (ΔD) produced by a corresponding incremental increase in log exposure (Δ log E) and indicates the maximum gamma measured over an exposure range extending between a first characteristic curve reference point lying at a density of 0.15 above minimum density and a second characteristic curve reference point separated from the first reference point by 0.9 log E.

The term "exposure latitude" indicates the exposure range of a characteristic curve segment over which the instantaneous gamma (ΔD/Δlog E) is at least 25 percent of the gamma, as defined above. The exposure latitude of a color element having multiple color recording units is the exposure range over which the characteristic curves of the red, green and blue color recording units simultaneously fulfill the aforesaid definition.

Speed is reported in relative log speed units. Each unit difference in relative speed represents 0.01 log E. Speed was measured at a toe density $D_s$, where $D_s$ minus $D_{min}$ equals 20 percent of the slope of a line drawn between D, and a point D' on the characteristic curve offset from $D_s$ by 0.6 log E.

*Research Disclosure* is published by Kenneth Mason Publications, Ltd., Dudley House, 12 North St., Emsworth, Hampshire P010 7DQ, England.

BACKGROUND OF THE INVENTION

Color negative photographic elements are conventionally formed with superimposed red, green and blue recording layer units coated on a support.

The red, green and blue recording layer units contain radiation-sensitive silver halide emulsions that form a latent image in response to red, green and blue light, respectively. Additionally, the red recording layer unit contains a cyan dye image-forming coupler, the green recording layer unit contains a magenta dye image-forming coupler, and the blue recording layer unit contains a yellow dye image-forming coupler.

Reproduction of subject images begins with imagewise exposure of color negative elements, commonly referred to as taking elements, in a camera. Following imagewise exposure, the color negative photographic elements are processed in a color developer, which contains a color developing agent that is oxidized while selectively reducing to silver latent image bearing silver halide grains. The oxidized color developing agent then reacts with the dye image-forming coupler in the vicinity of the developed grains to produce a dye image. Cyan (red-absorbing), magenta (green-absorbing) and yellow (blue-absorbing) dye images are formed in the red, green and blue recording layer units respectively. Subsequently the element is bleached (i.e., developed silver is converted back to silver halide) to eliminate neutral density attributable to developed silver and then fixed (i.e., silver halide is removed) to provide stability during subsequent room light handling.

When processing is conducted as noted above, negative dye images are produced. To produce a viewable positive dye image and hence to produce a visual approximation of the hues of the subject photographed, white light is typically passed through the color negative image to expose a second color photographic element having red, green and blue recording layer units as described above, usually coated on a white reflective support. The second element is commonly referred to as a color print element, and the process of exposing the color print element through the image bearing color negative element is commonly referred to as printing. Processing of the color print element as described above produces a viewable positive image that approximates that of the subject originally photographed.

Whereas color print elements are exposed using a controlled light source, a color negative taking element must function under a variety of lighting conditions. Lighting can range from below the detection threshold of the taking element to very high levels, sometimes in the same subject. When light available during exposure is marginal, increased sensitivity of the color negative elements greatly increases the opportunities for capture of pleasing and superior quality photographic images. When lighting varies widely within the same scene being photographed, wide exposure latitude is required.

Color negative photographic elements that employ a single red recording emulsion layer, a single green recording emulsion layer, and a single red recording emulsion layer are commonly referred to as "single coated". It has been long recognized that increased speed and exposure latitude can be realized in color negative elements by dividing each of the red, green and blue recording layer units into layer units differing in speed. Color negative photographic elements having layer units divided into two or three layer units for recording in the same region of the spectrum are commonly referred to as "double coated" or "triple coated", respectively. Illustrations of triple coated color negative elements are provided by Chang et al U.S. Pat. Nos. 5,314,793 and 5,360,703 and Kumai et al U.S. Pat. No. 3,843,369.

Many corrections for errors in color reproduction are built into color negative elements. For example, if color developing agent oxidized in one layer unit migrates to a second layer unit for creating a dye image of a different hue and reacts with a dye-forming coupler in the second layer unit, color contamination occurs. To prevent this from occurring, it is common practice to incorporate an oxidized developing agent scavenger in an interlayer separating the layer units or, less commonly, in the emulsion layers of the layer units. Oxidized development agent scavenging compounds, also sometimes referred to as anti-stain agents, are illustrated by *Research Disclosure*, Item 38957, X. Dye image formers and modifiers, D. Hue modifiers/stabilization, paragraph (2). Zengerle et al U.S. Pat. No. 5,585,230 discloses small, similar quantities of a dihydroxybenzene reducing agent applied to all emulsion layers of a triple coated green recording layer unit. Yamakawa et al EP 0 556 700 A1 discloses a ballasted dihydroxybenzene compound in the fastest layer only of a triple coated color negative element. Harder et al U.S. Pat. No. 5,629,140 describes the use of certain hydrazide compounds in color photographic elements in reactive association with 5-pyrazolone magenta dye forming couplers.

Another source of color error in color negative imaging stems from lack of accuracy in color reproduction by dye-forming couplers. Although the error is not large in the taking film, this error is cascaded forward when exposing the color print, resulting in an objectionably large error in color fidelity, absent correction. Typically masking couplers are incorporated in the color negative taking element at concentrations of about 0.2 millimole/$m^2$ or greater. Illustrations of colored masking couplers are provided by *Research Disclosure*, Vol. 389, September 1996, Item 38957, XII. Features applicable only to color negative, paragraphs (1) and (2). The colored masking couplers lose or change their color in areas in which grain development occurs to produce a dye image that is a reversal of the unwanted absorption of the image dye. This has the effect of neutralizing unwanted spectral absorption by the image dyes by raising the neutral density of the processed color negative element. However, this is not a practical difficulty, since this is easily offset by increasing exposure levels when exposing the print element through the color negative element.

In recent years increased reliance has also been placed on the incorporation of development inhibitor releasing (DIR) compounds for improving viewable dye images. Development inhibitors, which are rendered mobile by release during color development, improve the dye image by interacting with adjacent layer units to create favorable interimage effects and by sharpening dye image edge definition. Illustrations of development inhibitor releasing compounds are provided by *Research Disclosure*, Item 38957, cited above, X. Dye image formers and modifiers, C. Image dye modifiers.

Instead of printing through the color negative image in the taking element to produce a viewable color reproduction of the subject photographed, interest has developed in recent years in scanning the image-bearing color negative taking element to create a digital record of the blue, green and red exposure records in the color negative taking element. Since these color records can be manipulated while in electronic form, it has been recognized that many of the image enhancement techniques created for obtaining optimum color reproductions by direct optical printing can be dispensed with while still other image enhancement techniques can be employed for achieving color reproductions using digital color records. Sutton U.S. Pat. No. 5,389,506 illustrates triple coated color negative elements intended to be scanned for image retrieval followed by manipulation of digital color records in electronic form to produce a viewable color reproduction.

Simons UK 2 302 411 describes photographic recording materials that form a silver metal image containing a non-wandering silver halide black-and-white developing agent that may be suitable for color photographic elements intended for scanning. Dye image-forming couplers are absent, and dye images are not formed; the most sensitive layers of color recording units subdivided into more than one layer require the presence of the non-wandering developing agent.

RELATED APPLICATIONS

Begley et al U.S. Ser. No. 08/846,910, filed Apr. 30, 1997, commonly assigned, titled COLOR PHOTOGRAPHIC ELEMENT CONTAINING OXIDIZED DEVELOPER-SCAVENGING NAPHTHOLIC COUPLER FORMING WASH-OUT DYE, discloses in Example 4 a triple coated green recording layer unit having oxidized developing agent scavenger in the slow and medium speed emulsion layers, but no oxidized developing agent scavenger in the fast emulsion layer.

Sowinski et al U.S. Ser. No. 09/066,137, filed Apr. 24, 1998 (as a continuation-in-part of U.S. Ser. No. 08/940,527, filed Sep. 30, 1997, now abandoned), commonly assigned, titled A COLOR NEGATIVE FILM FOR PRODUCING IMAGES OF REDUCED GRANULARITY WHEN VIEWED FOLLOWING ELECTRONIC CONVERSION, teaches that images of reduced granularity result following electronic conversion of color negatives that are substantially free of colored masking couplers and that select DIR's with a diffusion factor of less than 0.4, contrary to widespread teachings in the art. The use of oxidized developer scavenging compounds to reduce element granularity is not described.

SUMMARY OF THE INVENTION

In one aspect this invention is directed to a color negative photographic element for producing a color image suited for conversion to an electronic form and subsequent reconversion into a viewable form comprised of a support and, coated on the support, a plurality of hydrophilic colloid layers, including radiation-sensitive silver halide emulsion layers, forming layer units for separately recording blue, green and red exposures, each of the layer units -containing dye image-forming coupler chosen to produce image dye having an absorption half-peak bandwidth lying in a different spectral region in each layer unit, wherein at least one of the color recording layer units exhibits a dye image gamma between about 0.1 and 1.0 and is subdivided into at least first, second and third light sensitive layers spectrally sensitized to the same region of the visible spectrum, the first layer is least sensitive of the first, second and third light sensitive layers, the second layer is more sensitive than the first layer and coated farther from the support than the first layer, the first and second layers contain in the range of 0.15–1.5 mmol/m$^2$ of oxidized developing agent scavenging compound, the third layer is more sensitive than the second layer and coated farther from the support than the second layer, and the third layer contains less than 50% of the oxidized developing agent scavenger compound contained in the second layer.

It has been discovered quite unexpectedly that the color negative elements of the invention produce dye images that are increased in speed and reduced in granularity. These advantages are particularly valuable in color negative elements intended to be scanned for dye image record retrieval that have been simplified in construction by departing from the masking coupler and DIR incorporation practices typically employed color negative elements used for optical printing. For example, increased granularity that results from removing or employing low (<0.4) diffusion factor DIR compounds in color negative elements intended to be scanned can be reduced or offset by the color negative element features herein contemplated.

Quite surprisingly, the advantages noted above are realized even when the color negative elements of the invention are exposed under such low lighting conditions that allow latent image formation in only the most sensitive emulsion layer of a triple coated layer unit.

DESCRIPTION OF PREFERRED EMBODIMENTS

A typical color negative film construction useful in the practice of the invention is illustrated by the following:

| Element SCN-1 | |
|---|---|
| SOC | Surface Overcoat |
| BU | Blue Recording Layer Unit |
| IL1 | First Interlayer |
| GU | Green Recording Layer Unit |
| IL2 | Second Interlayer |
| RU | Red Recording Layer Unit |
| AHU | Antihalation Layer Unit |
| S | Support |
| SOC | Surface Overcoat |

The support S can be either reflective or transparent, which is usually preferred. When reflective, the support is white and can take the form of any conventional support currently employed in color print elements. When the support is transparent, it can be colorless or tinted and can take the form of any conventional support currently employed in color negative elements—e.g., a colorless or tinted transparent film support. Details of support construction are well understood in the art. Transparent and reflective support constructions, including subbing layers to enhance adhesion, are disclosed in *Research Disclosure*, Item 38957, cited above, XV. Supports.

Any of the blue, green and red recording layer units BU, GU and RU can be formed of one or more hydrophilic colloid layers and contain at least one radiation-sensitive silver halide emulsion and at least one coupler, including at least one dye image-forming coupler. In the color negative elements of the invention one or more of the blue, green and red recording units is subdivided into at least three recording layer sub-units. When only one of the layer units is subdivided into sub-units, the preferred layer unit for subdivision is the green recording layer unit, since the eye is most sensitive to the green region of the spectrum. When two the layer units are subdivided into sub-units, it is preferred to subdivide both the green and red recording layer units. Each of the blue, green and red recording layer units can be subdivided into sub-units. When two or three of the blue, green and red recording layer units are subdivided into sub-units, only one of the layer units need be subdivided into three separate sub-units to satisfy the requirements of the invention.

A preferred color negative film construction useful in the practice of the invention is illustrated by the following:

| Element SCN-2 | |
|---|---|
| SOC | Surface Overcoat |
| BU | Blue Recording Layer Unit |
| IL1 | First Interlayer |
| FGU | Fast Green Recording Layer Sub-Unit |
| MGU | Mid Green Recording Layer Sub-Unit |
| SGU | Slow Green Recording Layer Sub-Unit |
| IL2 | Second Interlayer |
| RU | Red Recording Layer Unit |
| AHU | Antihalation Layer Unit |
| S | Support |
| SOC | Surface Overcoat |

While only the green recording layer unit is shown subdivided into sub-units, it is appreciated that either or both of the blue and red recording layer units can each be subdivided into two or three sub-units with the speed of the sub-units in each layer unit increasing as placement occurs progressively farther above the support.

In the simplest contemplated construction each of the layer units or layer sub-units consists of a single hydrophilic colloid layer containing emulsion and coupler. When coupler present in a layer unit or layer sub-unit is coated in a hydrophilic colloid layer other than an emulsion containing layer, the coupler containing hydrophilic colloid layer is positioned to receive oxidized color developing agent from the emulsion during development. Usually the coupler containing layer is the next adjacent hydrophilic colloid layer to the emulsion containing layer.

The emulsion in BU is capable of forming a latent image when exposed to blue light. When the emulsion contains high bromide silver halide grains and particularly when minor (0.5 to 20, preferably 1 to 10, mole percent, based on silver) amounts of iodide are also present in the radiation-sensitive grains, the native sensitivity of the grains can be relied upon for absorption of blue light. Preferably the emulsion is spectrally sensitized with one or more blue spectral sensitizing dyes. The emulsions in GU and RU are spectrally sensitized with green and red spectral sensitizing dyes, respectively, in all instances, since silver halide emulsions have no native sensitivity to green and/or red (minus blue) light.

Any convenient selection from among conventional radiation-sensitive silver halide emulsions can be incorporated within the layer units. Most commonly high bromide emulsions containing a minor amount of iodide are employed. To realize higher rates of processing high chloride emulsions can be employed. Radiation-sensitive silver chloride, silver bromide, silver iodobromide, silver iodochloride, silver chlorobromide, silver bromochloride, silver iodochlorobromide and silver iodobromochloride grains are all contemplated. The grains can be either regular or irregular (e.g., tabular). Tabular grain emulsions, those in which tabular grains account for at least 50 (preferably at least 70 and optimally at least 90) percent of total grain projected area are particularly advantageous for increasing speed in relation to granularity. To be considered tabular a grain requires two major parallel faces with a ratio of its equivalent circular diameter (ECD) to its thickness of at least 2. Specifically preferred tabular grain emulsions are those having a tabular grain average aspect ratio of at least 5 and, optimally, greater than 8. Preferred mean tabular grain thicknesses are less than 0.3 $\mu$m (most preferably less than 0.2 $\mu$m). Ultrathin tabular grain emulsions, those with mean tabular grain thicknesses of less than 0.07 $\mu$m, are specifically preferred. The grains preferably form surface latent images so that they produce negative images when processed in a surface developer.

Illustrations of conventional radiation-sensitive silver halide emulsions are provided by *Research Disclosure*, Item 38957, cited above, I. Emulsion grains and their preparation. Chemical sensitization of the emulsions, which can take any conventional form, is illustrated in section IV. Chemical sensitization. Spectral sensitization and sensitizing dyes, which can take any conventional form, are illustrated by section V. Spectral sensitization and desensitization. The emulsion layers also typically include one or more antifoggants or stabilizers, which can take any conventional form, as illustrated by section VII. Antifoggants and stabilizers.

BU contains at least one yellow dye image-forming coupler, GU contains at least one magenta dye image-forming coupler, and RU contains at least one cyan dye image-forming coupler. Any convenient combination of conventional dye image-forming couplers can be employed. Conventional dye image-forming couplers are illustrated by *Research Disclosure*, Item 38957, cited above, X. Dye image formers and modifiers, B. Image-dye-forming couplers.

The invention is applicable to conventional color negative film constructions. In a preferred embodiment, contrary to conventional color negative film constructions, RU, GU and BU are each substantially free of colored masking coupler. Preferably the layer units each contain less than 0.05 (most preferably less than 0.01) millimole/$m^2$ of colored masking coupler. No colored masking coupler is required in the color negative elements of this invention.

Development inhibitor releasing compound is preferably incorporated in at least one and, preferably, each of the layer units. DIR's are commonly employed to improve image sharpness and to tailor dye image characteristic curve shapes. The DIR's contemplated for incorporation in the color negative elements of the invention can release development inhibitor moieties directly or through intermediate linking or timing groups. The DIR's are contemplated to include those that employ anchimeric releasing mechanisms. Illustrations of development inhibitor releasing couplers and other compounds useful in the color negative elements of this invention are provided by *Research Disclosure*, Item 38957, cited above, X. Dye image formers and modifiers, C. Image dye modifiers, particularly paragraphs (4) to (11).

It is common practice to coat one, two or three separate emulsion layers within a single dye image-forming layer unit. The invention requires that one or more color recording units be subdivided into at least three layers comprised of emulsions sensitized to the same region of the visible spectrum, but differing in sensitivity (speed). In the required triple coated layer unit, as among the three sub-units, the most sensitive emulsion containing sub-unit is located nearest the source of exposing radiation, and the slowest emulsion containing sub-layer is located nearest the support. This sensitivity relationship also is preferable when the one or both of the two remaining layer units are also subdivided into sub-units. This sensitivity relationship of the sub-units increases the speed of the layer unit, whereas coating the fastest sub-unit nearest the support and the slowest farthest from the support increases contrast.

Incorporated into the least sensitive sub-unit and the adjacent, more sensitive sub-unit farther from the support of a layer unit subdivided into three or more sub-units is oxidized developing agent scavenging compound. The least sensitive layer and the adjacent more sensitive layer contain at least 0.15 mmol/$m^2$ of the scavenging compound. Preferably they are comprised of about 0.25 mmol/$m^2$. Generally no useful purpose is accomplished by increasing the concentration of the oxidized developing agent scavenging compound within any single sub-unit above 1.5 mmol/$m^2$. The amounts of oxidized developing agent scavenging compound contained in the least sensitive sub-unit and the adjacent sub-unit are not required to be the same as long as the minimum requirement is satisfied. If the amounts contained in these two sub-units are different, it is preferred that the higher level of scavenging compound be contained in the sub-unit farther from the support adjacent to the least sensitive sub-unit. Different oxidized developing agent scavenging compounds may be employed in the least sensitive sub-unit and the adjacent sub-unit, or blends of two or more different oxidized developing agent scavenging compounds may be used, as long as the minimum requirement is satisfied.

The highest sensitivity sub-unit contains no more than 50% of the amount of oxidized developing agent scavenger contained in the sub-unit which it immediately overlies—i.e., the sub-unit noted above to be coated farther from the support than and adjacent to the least sensitive sub-unit. It is preferred that the amount of scavenging compound in the highest sensitivity layer is less than 0.15 mmol/$m^2$. It is more preferred that the compound in this layer not exceed about 0.08 mmol/$m^2$. In still more preferred embodiments, about 0.05 mmol/$m^2$ of oxidized developer scavenging compound is contained in the highest sensitivity layer. The invention does not require that this layer contain oxidized scavenging compound, and this layer is in most instances substantially free of oxidized developing agent scavenging compound. Different oxidized developer scavenging compounds may be employed in the most sensitive sub-unit than in the least sensitive sub-unit or the interposed intermediate sensitivity sub-unit, as long as the level adheres to the limit restriction. Blends of two or more different oxidized developing agent scavenging compounds can be used in the most sensitive sub-unit, as long as the total concentration of all oxidized developing agent scavenging remains within the concentration ranges noted above.

Oxidized developing agent scavenging compounds are most commonly employed in interlayers to prevent color contamination by oxidized developer formed in one color recording unit from wandering into another unit and forming image dye falsely. Typically oxidized developing agent scavengers reduce or eliminate oxidized developing agent without forming any permanent dyes that remain in the processed film and do not cause significant stains nor release fragments that have photographic activity. In addition, these scavenging compounds are generally rendered substantially immobile by an anti-diffusion group (ballast) or by attachment to a polymer backbone to enable their incorporation into a particular layer within the photographic element while preventing their diffusion following application by coating and through the course of storage, exposure, processing, and drying. When the scavenging compounds are attached to a polymer backbone, coating coverages are based on the average molecular weight of the repeating sequences containing a single oxidized developing agent scavenging moiety. The scavenging compounds can be completely immobile or show limited mobility within the emulsion layer in which they are contained, but show insufficient mobility to permit any significant fraction of the scavenging compound to diffuse into adjacent layers prior to or during processing.

The most commonly employed oxidized developing agent scavengers are ballasted polyfunctionalized aromatic compounds containing multiple hydroxy, amino, and sulfonamido groups, and combinations thereof. Known oxidized developing agent scavengers include ballasted hydroquinone (1,4-dihydroxybenzene) compounds as described in Kneckel et al U.S. Pat. No. 3,700,453; ballasted gallic acid (1,2,3-trihydroxybenzene) derivatives as described in Shigeo et al U.S. Pat. No. 4,474,874; ballasted sulfonamidophenols as described in Erickson et al U.S. Pat. No. 4,205,987 and Ross et al U.S. Pat. No. 4,447,523; ballasted resorcinol (1,3-dihydroxybenzene) described in Gates et al U.S. Pat. No. 3,770,431; naptholic couplers which form a dye that is removed from the photographic recording material during color development and subsequent processing as described in Begley et al U.S. Ser. No. 08/846,910, filed Apr. 30, 1997; and ballasted hydrazides as described in Harder U.S. Pat. No. 4,923,787 and Harder et al U.S. Pat. No. 5,629,140. The disclosures of the references just described are incorporated herein by reference. In addition, oxidized developing agent scavengers (antistain agents) suitable for the invention can be selected from among those disclosed by *Research Disclosure*, Item 38957, X. Dye image formers and modifiers, D. Hue modifiers/stabilization, paragraph (2).

The oxidized developing agent scavenging compounds contemplated for incorporation in the color negative elements of the invention are most preferably ballasted hydrazides or ballasted sulfonamidophenols. Ballasted 1,4-dihydroxbenzene compounds are also highly preferred. Preferred forms of incorporation of oxidized developer scavenging compounds suitable for the invention as dispersed solid particles are described in Henzel et al U.S. Pat. No. 4,927,744, Brick et al U.S. Pat. Nos. 5,455,155 and 5,460,933, and Zengerle et al U.S. Pat. No. 5,360,702, the disclosures of which are incorporated by reference.

The interlayers IL1 and IL2 are optional, but preferred to attain the lowest possible levels of color contamination. The interlayers are hydrophilic colloid layers having as their primary function color contamination reduction—i.e., prevention of oxidized developing agent from migrating to an adjacent recording layer unit before reacting with dye-forming coupler. The interlayers are in part effective simply by increasing the diffusion path length that oxidized developing agent must travel. To increase the effectiveness of the interlayers to intercept oxidized developing agent, it is conventional practice to incorporate oxidized developing agent scavenger, as previously described. When one or more silver halide emulsions in GU and RU are high bromide emulsions and, hence have significant native sensitivity to blue light, it is preferred to incorporate a yellow filter, such as Carey Lea silver or a yellow processing solution decolorizable dye, in IL1. Suitable yellow filter dyes can be selected from among those illustrated by *Research Disclosure*, Item 38957, VIII. Absorbing and scattering materials, B. Absorbing materials.

The antihalation layer unit AHU is also optional, but referred for improving imaging sharpness. The antihalation layer unit can alternatively be coated on the back side of the support—i.e., the side of the support that receives exposing radiation after the blue, green and red recording layer units. AHU typically contains a processing solution removable or decolorizable light absorbing material, such as one or a combination of pigments and dyes. Suitable materials can be selected from among those disclosed in *Research Disclosure*, Item 38957, VIII. Absorbing materials.

The surface overcoats SOC are hydrophilic colloid layers that are provided for physical protection of the color negative elements during handling and processing. Each SOC also provides a convenient location for incorporation of addenda that are most effective at or near the surface of the color negative element. In some instances the surface overcoat is divided into a surface layer and an interlayer, the latter functioning as spacer between the addenda in the surface layer and the adjacent recording layer unit. In another common variant form, addenda are distributed between the surface layer and the interlayer, with the latter containing addenda that are compatible with the adjacent recording layer unit. Most typically the SOC contains addenda, such as coating aids, plasticizers and lubricants, antistats and matting agents, such as illustrated by *Research Disclosure*, Item 38957, IX. Coating physical property modifying addenda. The SOC overlying the emulsion layers additionally preferably contains an ultraviolet absorber, such as illustrated by *Research Disclosure*, Item 38957, VI. UV dyes/optical brighteners/luminescent dyes, paragraph (1).

Instead of the layer unit sequence of elements SCN-1 and SCN-2, alternative recording layer unit sequences can be employed and are particularly attractive for some emulsion choices. Using high chloride emulsions and/or thin (<0.2 $\mu$m mean grain thickness) tabular grain emulsions all possible interchanges of the positions of BU, GU and RU can be undertaken without risk of blue light contamination of the minus blue records, since these emulsions exhibit negligible native sensitivity in the visible spectrum. For the same reason, it is unnecessary to incorporate blue light absorbers in the interlayers.

When the emulsion layers within a dye image-forming layer unit differ in speed, it is conventional practice to limit the incorporation of dye image-forming coupler in the layer of highest speed to less than a stoichiometric amount, based on silver. The function of the highest speed emulsion layer is to create the portion of the characteristic curve just above the minimum density—i.e., in an exposure region that is below the threshold sensitivity of the remaining emulsion layer or layers in the layer unit. In this way, adding the increased granularity of the highest sensitivity speed emulsion layer to the dye image record produced is minimized without sacrificing imaging speed.

In the foregoing discussion the blue, green and red recording layer units are described as containing yellow, magenta and cyan image dye-forming couplers, respectively, as is conventional practice in color negative elements used for printing. The invention can be suitably applied to conventional color negative construction as illustrated. In preferred embodiments, the color negative elements are intended for scanning to produce three separate electronic color records. Thus the actual hue of the image dye produced is of no importance. What is essential is merely that the dye image produced in each of the layer units be differentiable from that produced by each of the remaining layer units. To provide this capability of differentiation it is contemplated that each of the layer units contain one or more dye image-forming couplers chosen to produce image dye having an absorption half-peak bandwidth lying in a different spectral region. When the color negative image obtained by exposure and processing is intended to be retrieved by scanning, it is immaterial whether the blue, green or red recording layer unit forms a yellow, magenta or cyan dye having an absorption half peak bandwidth in the blue, green or red region of the spectrum, as is conventional in a color negative element intended for use in printing, or an absorption half peak bandwidth in any other convenient region of the spectrum, ranging from the near ultraviolet (300–400 nm) through the visible and through the near infrared (700–1200 nm), so long as the absorption half peak bandwidths of the image dye in the layer units extend non-coextensive wavelength ranges. Preferably each image dye exhibits an absorption half-peak band width that extends over at least a 25 (most preferably 50) nm spectral region that is not occupied by an absorption half-peak band width of another image dye. Ideally the image dyes exhibit absorption half-peak band widths that are mutually exclusive.

When a layer unit contains two or more emulsion layers differing in speed, it is possible to lower image granularity in the image to be viewed, recreated from an electronic record, by forming in each emulsion layer of the layer unit a dye image which exhibits an absorption half peak band width that lies in a different spectral region than the dye images of the other emulsion layers of layer unit. This technique is particularly well suited to elements in which the layer units are divided into sub-units that differ in speed. This allows multiple electronic records to be created for each layer unit, corresponding to the differing dye images formed by the emulsion layers of the same spectral sensitivity. The digital record formed by scanning the dye image formed by an emulsion layer of the highest speed is used to recreate the portion of the dye image to be viewed lying just above minimum density. At higher exposure levels second and, optionally, third electronic records can be formed by scanning spectrally differentiated dye images formed by the remaining emulsion layer or layers. These digital records contain less noise (lower granularity) and can be used in recreating the image to be viewed over exposure ranges above the threshold exposure level of the slower emulsion layers. This technique for lowering granularity is disclosed in greater detail by Sutton U.S. Pat. No. 5,314,794, the disclosure of which is here incorporated by reference.

Each layer unit of the color negative elements of the invention produces a dye image characteristic curve gamma of less than 1.5, which facilitates obtaining an exposure latitude of at least 2.7 log E. A minimum acceptable exposure latitude of a multicolor photographic element is that which allows accurately recording the most extreme whites (e.g., a bride's wedding gown) and the most extreme blacks (e.g., a bride groom's tuxedo) that are likely to arise in photographic use. An exposure latitude of 2.6 log E can just accommodate the typical bride and groom wedding scene. An exposure latitude of at least 3.0 log E is preferred, since this allows for a comfortable margin of error in exposure level selection by a photographer. Even larger exposure latitudes are specifically preferred, since the ability to obtain accurate image reproduction with larger exposure errors is realized. Whereas in color negative elements intended for printing, the visual attractiveness of the printed scene is often lost when gamma is exceptionally low, when color negative elements are scanned to create digital dye image records, contrast can be increased by adjustment of the electronic signal information. When the elements of the invention are scanned using a reflected beam, the beam travels through the layer units twice. This effectively doubles gamma ($\Delta D \div \Delta$ log E) by doubling changes in density ($\Delta D$). Thus, gamma's as low as 1.0 or even 0.5 are contemplated and exposure latitudes of up to about 5.0 log E or higher are feasible.

A number of modifications of color negative elements have been suggested for accommodating scanning, as illustrated by *Research Disclosure*, Item 38957, XIV. Scan facilitating features. These systems to the extent compatible with the color negative element constructions described above are contemplated for use in the practice of this invention. The retained silver and reflective (including fluorescent) interlayer constructions of paragraph (1) are not preferred. The features of paragraphs (2) and (3) are generally compatible with the preferred forms of the invention.

EXAMPLES

The invention can be better appreciated by reference to the following specific embodiments. All coating coverages are reported in parenthesis in terms of g/m$^2$, except as otherwise indicated. Silver halide coating coverages are reported in terms of silver. The symbol "M %" indicates mole percent.

Glossary of Acronyms

| | |
|---|---|
| HBS-1 | Tritolyl phosphate |
| HBS-2 | Di-n-butyl phthalate |
| HBS-3 | N-n-Butyl acetanilide |
| HBS-4 | Tris(2-ethylhexyl) phosphate |
| HBS-5 | Di-n-butyl sebacate |
| HBS-6 | N,N-Diethyl lauramide |
| H-1 | Bis(vinylsulfonyl)methane |
| TAI | 4-Hydroxy-6-methyl-1,3,3a,7-tetraazaindene, sodium salt |

ST-1

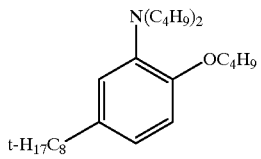

C-1

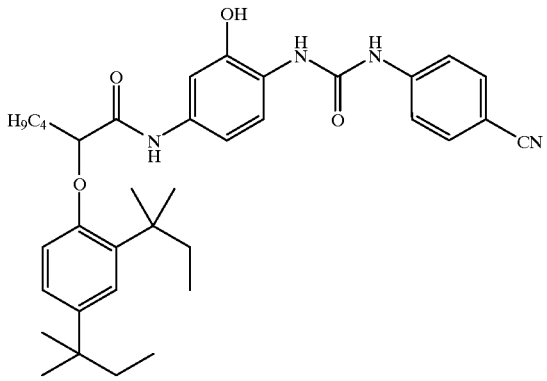

C-2

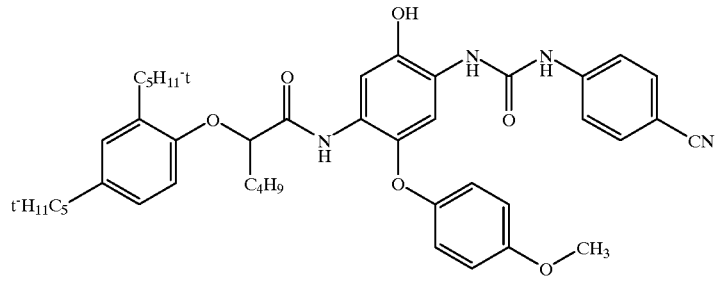

-continued
M-1
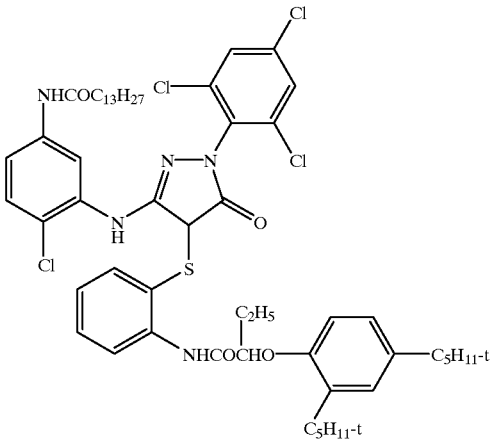
Y-1
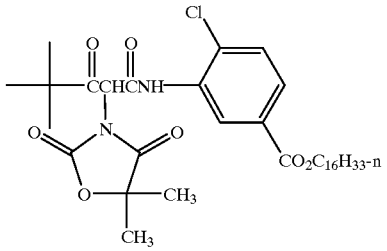
DIR-1
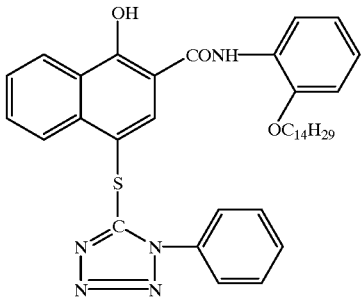
DIR-2
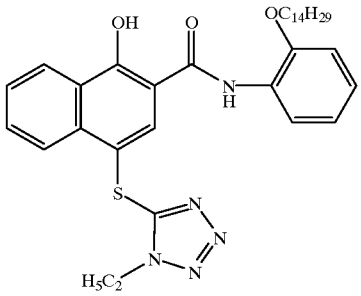

-continued
DIR-3
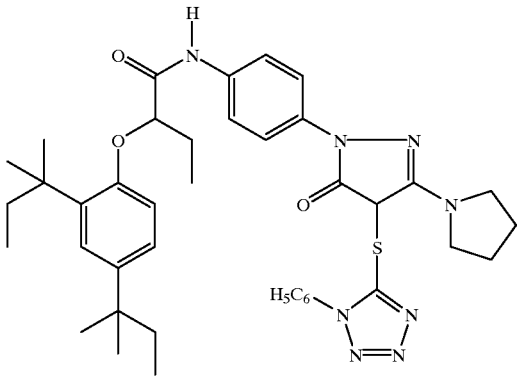
DIR-4
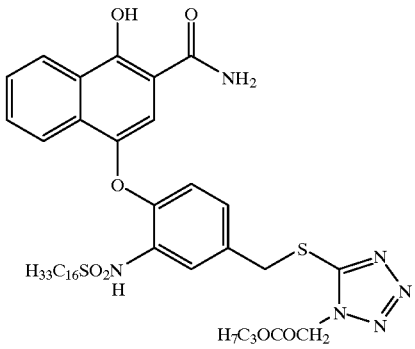
CM-1
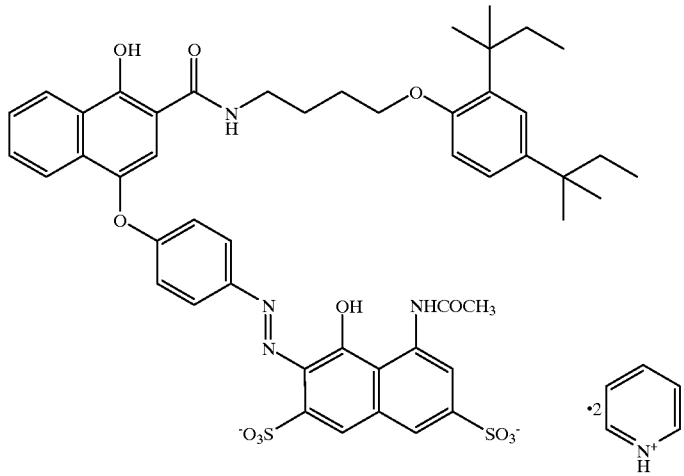

-continued
MM-1
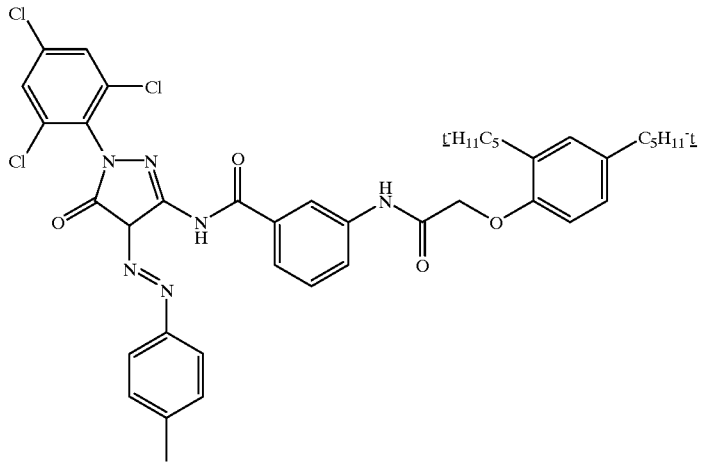
MD-1
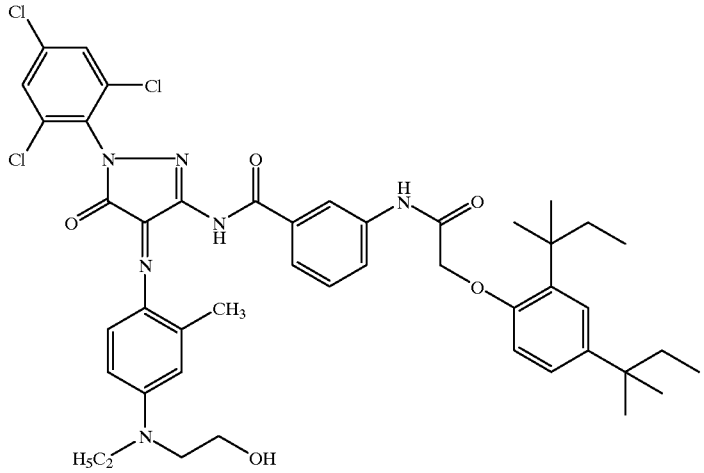
CD-1
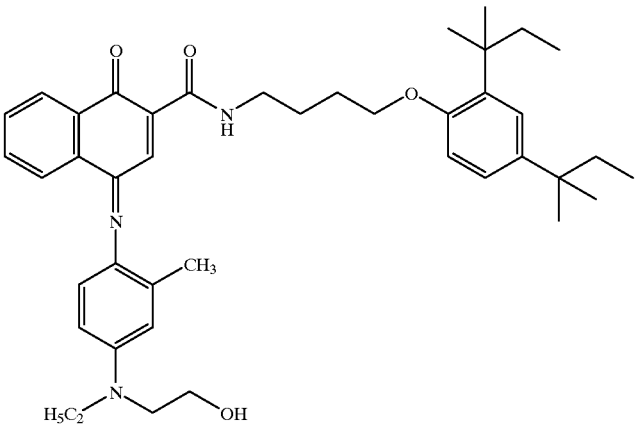

-continued
B-1
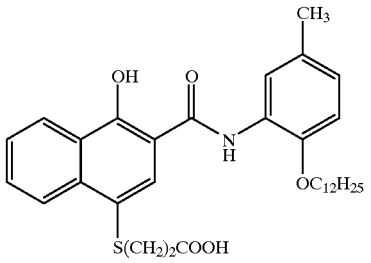
YD-1
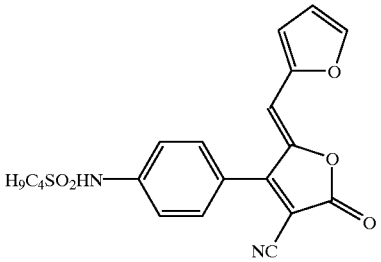
MD-2
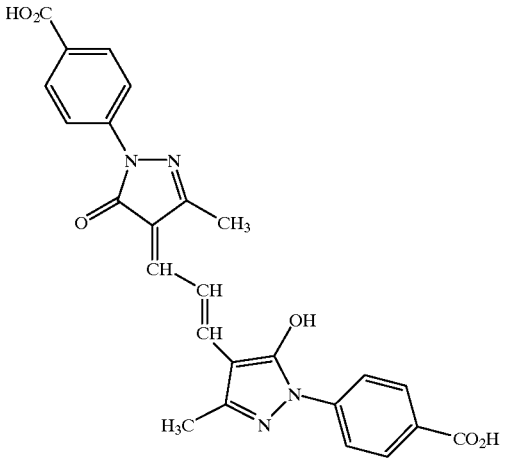
UV-1
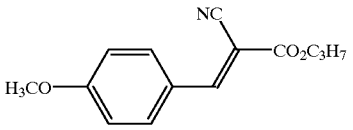
UV-2
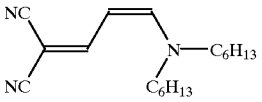

-continued

S-1

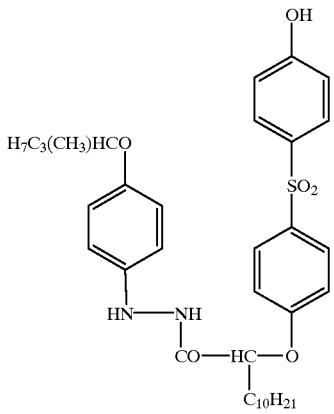

S-2

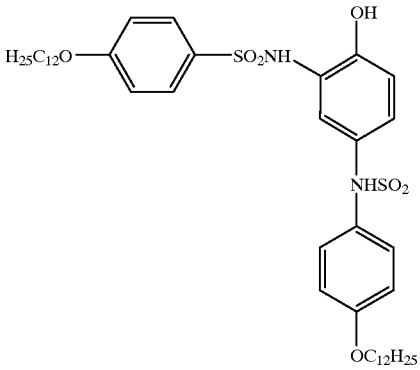

S-3

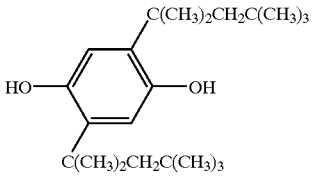

Samples 101–107

Sample 101 (comparative control)

This sample was prepared by applying the following layers in the sequence recited to a transparent film support of cellulose triacetate with conventional subbing layers, with the red recording layer unit coated nearest the support.

| | |
|---|---|
| Black colloidal silver sol | (0.107) |
| UV-1 | (0.075) |
| UV-2 | (0.075) |
| Oxidized developing agent scavenger S-3 | (0.161) |
| Compensatory printing density cyan dye CD-1 | (0.034) |
| Compensatory printing density magenta dye MD-1 | (0.013) |
| Compensatory printing density yellow dye MM-1 | (0.129) |
| HBS-1 | (0.105) |
| HBS-2 | (0.433) |
| HBS-4 | (0.013) |
| Disodium salt of 3,5-disulfocatechol | (0.215) |
| Gelatin | (2.152) |

Layer 2: SRU

This layer was comprised of a blend of a lower and higher (lower and higher grain ECD) sensitivity, red sensitized tabular silver iodobromide emulsions respectively containing 1.5 M % and 4.1 M % iodide, based on silver.

| | |
|---|---|
| AgIBr (0.55 μm ECD, 0.08 μm t) | (0.355) |
| AgIBr (0.66 μm ECD, 0.12 μm t) | (0.328) |
| Bleach accelerator coupler B-1 | (0.075) |
| DIR-1 | (0.011) |
| Cyan dye-forming coupler C-1 | (0.344) |
| HBS-1 | (0.043) |
| HBS-2 | (0.344) |
| HBS-6 | (0.098) |
| TAI | (0.011) |
| Gelatin | (1.668) |

Layer 3: MRU

This layer was comprised of a red sensitized tabular silver iodobromide emulsion containing 4.1 M % iodide, based on silver.

| | |
|---|---|
| AgIBr (1.30 μm ECD, 0.12 μm t) | (1.162) |
| Bleach accelerator coupler B-1 | (0.005) |
| DIR-1 | (0.011) |
| Cyan dye-forming coupler C-1 | (0.151) |
| HBS-1 | (0.043) |
| HBS-2 | (0.151) |
| HBS-6 | (0.007) |

-continued

| | |
|---|---|
| TAI | (0.019) |
| Gelatin | (1.291) |

Layer 4: FRU

This layer was comprised of a red sensitized tabular silver iodobromide emulsion containing 3.7 M % iodide, based on silver.

| | |
|---|---|
| AgIBr (2.61 μm ECD, 0.12 μm t) | (1.060) |
| Bleach accelerator coupler B-1 | (0.005) |
| DIR-1 | (0.015) |
| DIR-2 | (0.011) |
| Cyan dye-forming coupler C-1 | (0.108) |
| HBS-1 | (0.103) |
| HBS-2 | (0.097) |
| HBS-6 | (0.007) |
| TAI | (0.011) |
| Gelatin | (1.291) |

Layer 5: Interlayer

| | |
|---|---|
| Oxidized developing agent scavenger S-3 | (0.086) |
| HBS-4 | (0.129) |
| Gelatin | (0.538) |

Layer 6: SGU

This layer was comprised of a blend of a lower and higher (lower and higher grain ECD) sensitivity, green sensitized tabular silver iodobromide emulsions respectively containing 2.6 M % and 4.1 M % iodide, based on silver.

| | |
|---|---|
| AgIBr (0.81 μm ECD, 0.12 μm t) | (0.323) |
| AgIBr (0.92 μm ECD, 0.12 μm t) | (0.110) |
| DIR-3 | (0.011) |
| Bleach accelerator coupler B-1 | (0.011) |
| Magenta dye-forming coupler M-1 | (0.339) |
| Stabilizer ST-1 | (0.034) |
| HBS-1 | (0.327) |
| HBS-6 | (0.015) |
| TAI | (0.007) |
| Gelatin | (1.722) |

Layer 7: MGU

This layer was comprised of a blend of a lower and higher (lower and higher grain ECD) sensitivity, green sensitized tabular silver iodobromide emulsions each containing 4.1 M % iodide, based on silver.

| | |
|---|---|
| AgIBr (0.92 μm ECD, 0.12 μm t) | (0.108) |
| AgIBr (1.22 μm ECD, 0.11 μm t) | (1.334) |
| DIR-3 | (0.011) |
| Bleach accelerator coupler B-1 | (0.011) |
| Magenta dye-forming coupler M-1 | (0.065) |
| HBS-1 | (0.080) |
| HBS-6 | (0.015) |
| Stabilizer ST-1 | (0.007) |
| TAI | (0.023) |
| Gelatin | (1.668) |

Layer 8: FGU

This layer was comprised of a green-sensitized tabular silver iodobromide emulsion containing 4.1 M % iodide, based on silver.

| | |
|---|---|
| AgIBr (2.49 μm ECD, 0.14 μm t) | (0.909) |
| DIR-3 | (0.015) |
| Magenta dye-forming coupler M-1 | (0.058) |
| HBS-1 | (0.082) |
| Stabilizer ST-1 | (0.005) |
| TAI | (0.011) |
| Gelatin | (1.194) |

Layer 9: Yellow Filter Layer

| | |
|---|---|
| Yellow filter dye YD-1 | (0.129) |
| Oxidized developing agent scavenger S-3 | (0.086) |
| HBS-4 | (0.129) |
| Gelatin | (0.646) |

Layer 10: SBU

This layer was comprised of a blend of a lower, medium and higher (lower, medium and higher grain ECD) sensitivity, blue-sensitized tabular silver iodobromide emulsions respectively containing 1.5 M %, 1.5 M % and 4.1 M % iodide, based on silver.

| | |
|---|---|
| AgIBr (0.55 μm ECD, 0.08 μm t) | (0.156) |
| AgIBr (0.77 μm ECD, 0.14 μm t) | (0.269) |
| AgIBr (1.25 μm ECD, 0.14 μm t) | (0.430) |
| DIR-4 | (0.011) |
| DIR-3 | (0.016) |
| Yellow dye-forming coupler Y-1 | (0.807) |
| Bleach accelerator coupler B-1 | (0.011) |
| HBS-1 | (0.435) |
| HBS-2 | (0.022) |
| HBS-6 | (0.014) |
| TAI | (0.014) |
| Gelatin | (2.120) |

Layer 11: FBU

This layer was comprised of a blue-sensitized silver iodobromide emulsion containing 9.0 M % iodide, based on silver.

| | |
|---|---|
| AgIBr (1.04 μm ECD) | (0.699) |
| Unsensitized silver bromide Lippmann emulsion | (0.054) |
| Yellow dye-forming coupler Y-1 | (0.215) |
| DIR-3 | (0.022) |
| Bleach accelerator coupler B-1 | (0.005) |
| HBS-1 | (0.151 |
| HBS-6 | (0.007) |
| TAI | (0.012) |
| Gelatin | (1.183) |

Layer 12: Ultraviolet Filter Layer

| | |
|---|---|
| Dye UV-1 | (0.108) |
| Dye UV-2 | (0.108) |
| Unsensitized silver bromide Lippmann emulsion | (0.215) |
| HBS-1 | (0.151) |
| Gelatin | (0.699) |

Layer 13: Protective Overcoat Layer

| | |
|---|---|
| Poly(methylmethacrylate) matte beads | (0.005) |
| Soluble poly(methylmethacrylate) matte beads | (0.108) |
| Silicone lubricant | (0.039) |
| Gelatin | (0.882) |

This film was hardened at the time of coating with 1.80% by weight of total gelatin of hardener H-1. Surfactants, coating aids, soluble absorber dyes, antifoggants, stabilizers, antistatic agents, biostats, biocides, and other addenda chemicals were added to the various layers of this sample, as is commonly practiced in the art.

Sample 102 (comparative control)

Except as indicated below, this sample was prepared as described above in connection with Sample 101.

Layer 7: MGU Changes

| | |
|---|---|
| Oxidized developing agent scavenger S-1 | (0.097) |
| HBS-6 | (0.039) |

Sample 103 (comparative control)

Except as indicated below, this sample was prepared as described above in connection with Sample 101.

Layer 6: SGU Changes

| | |
|---|---|
| Oxidized developing agent scavenger S-1 | (0.097) |
| HBS-6 | (0.039) |

Sample 104 (example)

Except as indicated below, this sample was prepared as described above in connection with Sample 101.

Layer 6: SGU Changes

| | |
|---|---|
| Oxidized developing agent scavenger S-1 | (0.097) |
| HBS-6 | (0.039) |

Layer 7: MGU Changes

| | |
|---|---|
| Oxidized developing agent scavenger S-1 | (0.097) |
| HBS-6 | (0.039) |

Sample 105 (example)

Except as indicated below, this sample was prepared as described above in connection with Sample 101.

Layer 6: SGU Changes

| | |
|---|---|
| Oxidized developing agent scavenger S-2 | (0.119) |
| HBS-1 | (0.446) |

Layer 7: MGU Changes

| | |
|---|---|
| Oxidized developing agent scavenger S-2 | (0.119) |
| HBS-1 | (0.199) |

Sample 106 (example)

Except as indicated below, this sample was prepared as described above in connection with Sample 101. The oxidized developer scavenging compound S-3 was prepared without conventional coupler solvent as a milled solid particle dispersion according to the teachings of Henzel et al U.S. Pat. No. 4,927,744.

Layer 6: SGU Changes

| | |
|---|---|
| Oxidized developing agent scavenger S-3 | (0.052) |

Layer 7: MGU Changes

| | |
|---|---|
| Oxidized developing agent scavenger S-3 | (0.052) |

Sample 107 (example)

Except as indicated below, this sample was prepared as described above in connection with Sample 101.

Layer 6: SGU Changes

| | |
|---|---|
| Oxidized developing agent scavenger S-3 | (0.052) |
| HBS-4 | (0.077) |

Layer 7: MGU Changes

| | |
|---|---|
| Oxidized developing agent scavenger S-3 | (0.052) |
| HBS-4 | (0.077) |

Samples 101–107 were individually exposed for 1/500 a second to white light from a tungsten light source of 3200° K color temperature that was filtered by a Daylight Va filter to 5500° K and by 1.4 neutral density through a graduated 0–4.0 density step tablet to determine their speed. The samples were then processed using the KODAK Flexicolor C-41™ process, as described above. In addition, a set of unexposed Samples 101–107 were subjected to a variation of the Flexicolor™ processing steps to determine the residual minimum density of the samples associated with the colored masking dyes and stains, wherein the samples were bleached, water-washed, fixed, water-washed, developed, bleached, water-washed, fixed, water-washed, and stabilized using the same Flexicolor process chemical solutions at their respective usual times.

Following processing and drying, Samples 101–107 were subjected to Status M integral densitometry and their sensitometric performance was characterized. The recording material granularity was determined by scanning the samples with a microdensitometer employing a 48-micrometer aperture. The effect of oxidized developing agent scavenging compound on speed performance of the green-light sensitive color unit is shown in Table I. The net fog density was determined by subtracting the residual minimum density from the normal color negative process minimum density. Speed and gamma were obtained according to the definitions provided above. The characteristic curve properties are reported in Table I, and the granularity performance is shown in Table II.

TABLE I

| Sample | OXDAS * | in Green Rec. Layer Unit (mmol/m$^2$) | Net Fog Density | Gamma | Relative Speed |
|---|---|---|---|---|---|
| 101 (C) | None | F (0.00)<br>M (0.00)<br>S (0.00) | 0.219 | 0.74 | 100 |
| 102 (C) | S-1 | F (0.00)<br>M (0.16)<br>S (0.00) | 0.147 | 0.84 | 100 |
| 103 (C) | S-1 | F (0.00)<br>M (0.00)<br>S (0.16) | 0.161 | 0.56 | 102 |
| 104 (E) | S-1 | F (0.00)<br>M (0.16)<br>S (0.16) | 0.112 | 0.64 | 101 |

TABLE I-continued

| Sample | OXDAS * | in Green Rec. Layer Unit (mmol/m$^2$) | Net Fog Density | Gamma | Relative Speed |
|---|---|---|---|---|---|
| 105 (E) | S-2 | F (0.00)<br>M (0.15)<br>S (0.15) | 0.112 | 0.55 | 103 |
| 106 (E) | S-3 | F (0.00)<br>M (0.15)<br>S (0.15) | 0.113 | 0.72 | 100 |
| 107 (E) | S-3 | F (0.00)<br>M (0.15)<br>S (0.15) | 0.115 | 0.70 | 101 |

*OXDAS = oxidized developing agent scavenger

TABLE II

| Sample | OXDAS | in Green Rec. Layer Unit | Dmin Region $\sigma_D$ | Lower Scale $\sigma_D/\gamma$ | Lower Mid-scale $\sigma_D/\gamma$ | Mid- scale $\sigma_D/\gamma$ |
|---|---|---|---|---|---|---|
| 101 (C) | None | None | 0.0166 | 0.0276 | 0.0173 | 0.0131 |
| 102 (C) | S-1 | MGU | 0.0101 | 0.0238 | 0.0175 | 0.0123 |
| 103 (C) | S-1 | SGU | 0.0144 | 0.0267 | 0.0159 | 0.0109 |
| 104 (E) | S-1 | MGU, SGU | 0.0089 | 0.0218 | 0.0152 | 0.0101 |
| 105 (E) | S-2 | MGU, SGU | 0.0085 | 0.0225 | 0.0147 | 0.0099 |
| 106 (E) | S-3 | MGU, SGU | 0.0100 | 0.0242 | 0.0160 | 0.0109 |
| 107 (E) | S-3 | MGU, SGU | 0.0104 | 0.0232 | 0.0158 | 0.0113 |

From Table I is observed that the inclusion of oxidized developing agent scavenging compound (OXDAS) S-1 in both SGU and MGU simultaneously (104) at a level of at least 0.15 mmmol/m$^2$ according to the invention resulted in lower net fog than the comparative controls with scavenging compound only in one of the two layers, either SGU (102) or MGU (103), or the control that lacked any scavenger (101). The presence of oxidized developing agent scavenging compound according to the invention did not alter speed. The contrast of the Example coatings were in the same general ranges as the comparative control coatings.

Referring to Table II, the minimum density and lower scale granularity of the Examples (Samples 104–107) are clearly superior to those of the comparative controls (Samples 101–103). Thus, granularity was improved without any offsetting penalty to speed or contrast.

Samples 201–203

Sample 201 (example)

This sample was prepared by applying the following layers in the sequence recited to a transparent film support of cellulose triacetate with conventional subbing layers, with the red recording layer unit coated nearest the support. The side of the support to be coated had been prepared by the application of gelatin subbing.

Layer 1: AHU

| | |
|---|---|
| Black colloidal silver sol | (0.151) |
| UV-1 | (0.075) |
| UV-2 | (0.075) |
| Compensatory printing density cyan dye CD-1 | (0.005) |
| Compensatory printing density magenta dye MD-1 | (0.038) |
| Compensatory printing density yellow dye MM-1 | (0.274) |
| HBS-1 | (0.125) |
| HBS-4 | (0.038) |
| Disodium salt of 3,5-disulfocatechol | (0.269) |
| Gelatin | (3.228) |

Layer 2: Interlayer

| | |
|---|---|
| Oxidized developing agent scavenger S-1 | (0.072) |
| HBS-4 | (0.108) |
| Gelatin | (0.538) |

Layer 3: SRU

This layer was comprised of a blend of a lower, medium, and higher (lower, intermediate, and higher grain ECD) sensitivity, red-sensitized tabular silver iodobromide emulsions respectively containing 1.3 M %, 4.1 M % and 4.1 M % iodide, based on silver.

| | |
|---|---|
| AgIBr (0.55 $\mu$m ECD, 0.08 $\mu$m t) | (0.452) |
| AgIBr (1.00 $\mu$m ECD, 0.09 $\mu$m t) | (0.355) |
| AgIBr (1.25 $\mu$m ECD, 0.12 $\mu$m t) | (0.172) |
| Bleach accelerator coupler B-1 | (0.075) |
| Oxidized developing agent scavenger S-1 | (0.183) |
| DIR-4 | (0.013) |
| Cyan dye-forming coupler C-1 | (0.344) |
| Cyan dye-forming coupler C-2 | (0.172) |
| HBS-2 | (0.026) |
| HBS-5 | (0.118) |
| HBS-6 | (0.144) |
| TAI | (0.016) |
| Gelatin | (1.840) |

Layer 4: MRU

This layer was comprised of a red-sensitized tabular silver iodobromide emulsion containing 3.1 M % iodide, based on silver.

| | |
|---|---|
| AgIBr (2.25 $\mu$m ECD, 0.12 $\mu$m t) | (1.291) |
| Bleach accelerator coupler B-1 | (0.022) |
| DIR-4 | (0.011) |
| DIR-2 | (0.011) |
| Oxidized developing agent scavenger S-1 | (0.183) |
| Oxidized developing agent scavenger S-3 | (0.011) |
| Cyan dye-forming coupler C-1 | (0.108) |
| Cyan dye-forming coupler C-2 | (0.075) |
| HBS-1 | (0.044) |
| HBS-2 | (0.022) |
| HBS-4 | (0.017) |
| HBS-5 | (0.043) |
| HBS-6 | (0.074) |
| TAI | (0.021) |
| Gelatin | (1.560) |

Layer 5: FRU

This layer was comprised of a red-sensitized tabular silver iodobromide emulsion containing 3.7 M % iodide, based on silver.

| | |
|---|---|
| AgIBr (4.0 μm ECD, 0.13 μm t) | (1.614) |
| Bleach accelerator coupler B-1 | (0.003) |
| DIR-4 | (0.005) |
| DIR-2 | (0.011) |
| Oxidized developing agent scavenger S-3 | (0.014) |
| Cyan dye-forming coupler C-2 | (0.151) |
| HBS-1 | (0.044) |
| HBS-2 | (0.011) |
| HBS-4 | (0.021) |
| HBS-5 | (0.108) |
| HBS-6 | (0.004) |
| TAI | (0.026) |
| Gelatin | (1.829) |

Layer 6: Interlayer

| | |
|---|---|
| Magenta filter dye MD-2 | (0.065) |
| Oxidized developing agent scavenger S-3 | (0.108) |
| HBS-4 | (0.161) |
| Gelatin | (1.076) |

Layer 7: SGU

This layer was comprised of a blend of a lower, medium, and higher (lower, intermediate, and higher grain ECD) sensitivity, green-sensitized tabular silver iodobromide emulsions respectively containing 1.5 M %, 4.1 M %, and 4.1 M % iodide, based on silver.

| | |
|---|---|
| AgIBr (0.69 μm ECD, 0.12 μm t) | (0.226) |
| AgIBr (1.00 μm ECD, 0.08 μm t) | (0.086) |
| AgIBr (1.22 μm ECD, 0.11 μm t) | (0.430) |
| Bleach accelerator coupler B-1 | (0.011) |
| DIR-4 | (0.012) |
| Oxidized developing agent scavenger S-1 | (0.183) |
| Oxidized developing agent scavenger S-3 | (0.022) |
| Magenta dye-forming coupler M-1 | (0.215) |
| Stabilizer ST-1 | (0.022) |
| HBS-1 | (0.194) |
| HBS-2 | (0.024) |
| HBS-4 | (0.032) |
| HBS-6 | (0.060) |
| TAI | (0.012) |
| Gelatin | (1.184) |

Layer 8: MGU

This layer was comprised of a green-sensitized tabular silver iodobromide emulsion containing 3.6 M % iodide, based on silver.

| | |
|---|---|
| AgIBr (2.85 μm ECD, 0.12 μm t) | (0.968) |
| Bleach accelerator coupler B-1 | (0.011) |
| DIR-4 | (0.009) |
| DIR-2 | (0.009) |
| Oxidized developing agent scavenger S-1 | (0.183) |
| Oxidized developing agent scavenger S-3 | (0.011) |
| Magenta dye-forming coupler M-1 | (0.156) |
| HBS-1 | (0.159) |
| HBS-2 | (0.017) |
| HBS-4 | (0.016) |
| HBS-6 | (0.060) |
| Stabilizer ST-1 | (0.016) |
| TAI | (0.016) |
| Gelatin | (1.560) |

Layer 9: FGU

This layer was comprised of a green-sensitized tabular silver iodobromide emulsion containing 3.6 M % iodide, based on silver.

| | |
|---|---|
| AgIBr (3.95 μm ECD, 0.14 μm t) | (1.291) |
| DIR-4 | (0.011) |
| DIR-2 | (0.009) |
| Oxidized developing agent scavenger S-3 | (0.011) |
| Magenta dye-forming coupler M-1 | (0.102) |
| HBS-1 | (0.116) |
| HBS-2 | (0.022) |
| HBS-4 | (0.016) |
| Stabilizer ST-1 | (0.010) |
| TAI | (0.015) |
| Gelatin | (1.560) |

Layer 10: Yellow Filter Layer

| | |
|---|---|
| Yellow filter dye YD-1 | (0.108) |
| Oxidized developing agent scavenger S-3 | (0.075) |
| HBS-4 | (0.113) |
| Gelatin | (1.076) |

Layer 11: SBU

This layer was comprised of a blend of a lower, medium and higher (lower, medium and higher grain ECD) sensitivity, blue-sensitized tabular silver iodobromide emulsions respectively containing 1.5 M %, 1.5 M % and 4.1 M % iodide, based on silver.

| | |
|---|---|
| AgIBr (0.55 μm ECD, 0.08 μm t) | (0.258) |
| AgIBr (0.77 μm ECD, 0.14 μm t) | (0.194) |
| AgIBr (1.25 μm ECD, 0.14 μm t) | (0.334) |
| Bleach accelerator coupler B-1 | (0.003) |
| DIR-4 | (0.016) |
| Oxidized developing agent scavenger S-1 | (0.183) |
| Yellow dye-forming coupler Y-1 | (0.710) |
| HBS-2 | (0.032) |
| HBS-5 | (0.151) |
| HBS-6 | (0.050) |
| TAI | (0.014) |
| Gelatin | (1.506) |

Layer 12: FBU

This layer was comprised of a blend of a lower and higher (higher (conventional) and lower (tabular) grain ECD) sensitivity, blue-sensitized silver iodobromide emulsions respectively containing 4.1 M % and 14 M % iodide, based on silver

| | |
|---|---|
| AgIBr (2.9 μm ECD, 0.13 μm t) | (0.323) |
| AgIBr (1.4 μm ECD) | (0.968) |
| Bleach accelerator coupler B-1 | (0.011) |
| DIR-4 | (0.005) |
| Yellow dye-forming coupler Y-1 | (0.215) |
| HBS-2 | (0.011) |
| HBS-5 | (0.108) |
| HBS-6 | (0.014) |
| TAI | (0.014) |
| Gelatin | (1.506) |

Layer 13: Ultraviolet Filter Layer

| | |
|---|---|
| Dye UV-1 | (0.108) |
| Dye UV-2 | (0.108) |
| Compensatory printing density cyan dye CD-1 | (0.005) |
| Unsensitized silver bromide Lippmann emulsion | (0.215) |
| HBS-1 | (0.172) |
| Gelatin | (0.699) |

Layer 14: Protective Overcoat Layer

| | |
|---|---|
| Poly(methylmethacrylate) matte beads | (0.005) |
| Soluble poly(methylmethacrylate) matte beads | (0.108) |
| Silicone lubricant | (0.039) |
| Gelatin | (0.888) |

This film was hardened at the time of coating with 1.75% by weight of total gelatin of hardener H-1. Surfactants, coating aids, soluble absorber dyes, antifoggants, stabilizers, antistatic agents, biostats, biocides, and other addenda chemicals were added to the various layers of this sample, as is commonly practiced in the art.

Sample 202 (comparative control)

Except as indicated below, this sample was prepared as described above in connection with Sample 201.

Layer 2: SRU Changes

| | |
|---|---|
| Oxidized developing agent scavenger S-1 | (0.000) |
| HBS-6 | (0.098) |

Layer 3: MRU Changes

| | |
|---|---|
| Oxidized developing agent scavenger S-1 | (0.000) |
| HBS-6 | (0.028) |

Layer 6: SGU Changes

| | |
|---|---|
| Oxidized developing agent scavenger S-1 | (0.000) |
| HBS-6 | (0.014) |

Layer 7: MGU Changes

| | |
|---|---|
| Oxidized developing agent scavenger S-1 | (0.000) |
| HBS-6 | (0.014) |

Layer 10: SBU Changes

| | |
|---|---|
| Oxidized developing agent scavenger S-1 | (0.000) |
| HBS-6 | (0.004) |

Sample 203 (comparative control)

Except as indicated below, this sample was prepared as described above in connection with Sample 201.

Layer 4: FRU Changes

| | |
|---|---|
| Oxidized developing agent scavenger S-1 | (0.091) |
| HBS-6 | (0.027) |

Layer 8: FGU Changes

| | |
|---|---|
| Oxidized developing agent scavenger S-1 | (0.091) |
| HBS-6 | (0.023) |

Layer 11: FBU Changes

| | |
|---|---|
| Oxidized developing agent scavenger S-1 | (0.091) |
| HBS-6 | (0.037) |

Samples 201–203 were individually exposed for 1/500 a second to white light from a tungsten light source of 3200° K color temperature that was filtered by a Daylight Va filter to 5500° K and by 1.5 neutral density through a graduated 0–4.0 density step tablet. The samples were then processed using the KODAK Flexicolor™ C-41 process. Following processing and drying, Samples 201–203 were subjected to Status M integral densitometry and their sensitometric performance was determined.

The results are summarized in Table III.

TABLE III

| Sample | OXDAS | Coverage (mmol/m$^2$) | Gamma | Relative Speed | Exposure Latitude |
|---|---|---|---|---|---|
| 201 (E) | FGU | 0.03 | 0.55 | 114 | >3.30 |
| | MGU | 0.33 | | | |
| | SGU | 0.36 | | | |
| 202 (C) | FGU | 0.03 | 1.00 | 102 | 3.03 |
| | MGU | 0.03 | | | |
| | SGU | 0.06 | | | |
| 203 (C) | FGU | 0.18 | 0.54 | 100 | >3.08 |
| | MGU | 0.33 | | | |
| | SGU | 0.36 | | | |

When amounts of oxidized developing agent scavenger satisfying invention requirements are placed in the slow and mid sub-units the green recording layer unit, the result is a desirable increase in speed, an increase in exposure latitude (also highly desirable), and a reduction in contrast. The reduction in contrast actually facilitates scanning and contrast can be increased once the image information from the sample has been converted to a digital form. Hence, as compared to Sample 202, which lacks oxidized developing agent scavengers in the intended concentrations, Example Sample 201 exhibits superior imaging characteristics.

Comparative control Sample 203 has been included to demonstrate that the further addition of oxidized developing agent scavenger in the fast green recording sub-unit at concentrations higher than contemplated by the present invention significantly degrades performance. Speed is lowered and exposure latitude is also reduced. No offsetting advantages have been identified.

The invention has been described in detail with particular reference to preferred embodiments thereof, but it will be understood that variations and modifications can be effected within the spirit and scope of the invention.

What is claimed is:

1. A color negative photographic element for producing a color image suited for conversion to an electronic form and subsequent reconversion into a viewable form comprised of a support and, coated on the support, a plurality of hydrophilic colloid layers, including radiation-sensitive silver halide emulsion layers, forming layer units for separately recording blue, green and red exposures, each of the layer units containing dye image-forming coupler chosen to produce image dye having an absorption half-peak bandwidth lying in a different spectral region in each layer unit, WHEREIN at least one of the color recording layer units exhibits a dye image gamma between about 0.1 and 1.0 and is subdivided into at least first, second and third light sensitive layers spectrally sensitized to the same region of the visible spectrum, the first layer is least sensitive of the first, second and third light sensitive layers, the second layer is more sensitive than the first layer and coated farther from the support than the first layer, the first and second layers contain in the range of 0.15–1.5 $mmol/m^2$ of oxidized developing agent scavenging compound, the third layer is more sensitive than the second layer and coated farther from the support than the second layer, and the third layer contains less than 50% of the oxidized developing agent scavenger compound contained in the second layer.

2. A color negative photographic element according to claim 1 in which at least the green recording layer unit is subdivided into the first, second and third layers.

3. A color negative photographic element according to claim 2 in which the red recording layer unit is also subdivided into the first, second and third layers.

4. A color negative photographic element according to claim 1 wherein the second layer is coated over and in contact with the first layer and the third layer is coated over and in contact with the second layer.

5. A color negative photographic element according to claim 1 wherein development inhibitor releasing compound is present in at least one of the layer units.

6. A color negative photographic element according to claim 2 wherein the layer units are substantially free of colored masking coupler.

7. A color negative photographic element according to claim 6 wherein the layer units each exhibit an exposure latitude of at least 2.7 log E, where E is exposure measured in lux-seconds.

8. A color negative photographic element according to claim 1 wherein the third layer is substantially free of oxidized developing agent scavenging agent.

* * * * *